US009845971B1

(12) United States Patent
Wynnick et al.

(10) Patent No.: US 9,845,971 B1
(45) Date of Patent: Dec. 19, 2017

(54) STACKING BRACKETS AND SYSTEMS FOR ROOFTOP HVAC UNITS

(71) Applicant: Lennox Industries Inc., Richardson, TX (US)

(72) Inventors: David Michael Wynnick, Lewisville, TX (US); Corrine Anne Hudson, Dallas, TX (US); Timothy Grant Weigel, McKinney, TX (US)

(73) Assignee: Lennox Industries Inc., Richardson, TX (US)

( * ) Notice: Subject to any disclaimer, the term of this patent is extended or adjusted under 35 U.S.C. 154(b) by 0 days.

(21) Appl. No.: 15/264,556

(22) Filed: Sep. 13, 2016

(51) Int. Cl.

| | |
|---|---|
| ***F16M 1/00*** | (2006.01) |
| ***F24F 13/32*** | (2006.01) |
| ***B65D 85/68*** | (2006.01) |
| ***B65D 21/02*** | (2006.01) |

(52) U.S. Cl.
CPC ..... *F24F 13/32* (2013.01); *B65D 21/0215* (2013.01); *B65D 85/68* (2013.01); *B65D 2585/681* (2013.01); *B65D 2585/6812* (2013.01); *F24F 2221/12* (2013.01); *F24F 2221/16* (2013.01)

(58) Field of Classification Search
CPC .... F24F 13/32; F24F 2221/12; F24F 2221/16; B65D 85/68; B65D 21/0215; B65D 2585/681; B65D 2585/6812
USPC ..... 248/675, 674, 672, 237
See application file for complete search history.

(56) References Cited

U.S. PATENT DOCUMENTS

| | | | | |
|---|---|---|---|---|
| 1,541,872 | A * | 6/1925 | Stoddard | B65D 9/34 217/69 |
| 6,488,247 | B1 * | 12/2002 | Gonzalez | F24F 13/0209 248/201 |
| 6,530,191 | B2 * | 3/2003 | Rieke | E04C 2/292 428/178 |
| 9,151,535 | B2 * | 10/2015 | Wynnick | B65D 7/00 |
| 9,272,829 | B2 * | 3/2016 | Wynnick | B65D 7/00 |

* cited by examiner

*Primary Examiner* — Todd M Epps
(74) *Attorney, Agent, or Firm* — Hubbard Johnston, PLLC

(57) ABSTRACT

A system for securing at least two heating, ventilation, and air conditioning units stacked on each other for transportation includes corner brackets on at least the four corners of the lower unit and between the units. Each corner bracket has a banding channel, a plank-receiving channel, and a plurality of protrusions on a top side. The brackets are banded in place using the banding channels. On each longitudinal side, planks are used to extend between corner brackets to help control the loads and to distribute the loads. The corner brackets may be made from a synthetic material and the planks from wood or wood-like material. Other aspects are disclosed.

20 Claims, 7 Drawing Sheets

STACKING BRACKETS AND SYSTEMS FOR ROOFTOP HVAC UNITS

TECHNICAL FIELD

The present invention relates to stacking of heating, ventilation, and air conditioning (HVAC) units and, more particularly, to packaging and stacking brackets for rooftop HVAC units and methods of making and using the same.

BACKGROUND

Heating, ventilation, and air conditioning (HVAC) units are used to condition air to make a controlled environment more pleasant. Often in commercial buildings, such as grocery stores, restaurants, and other stores, rooftop units are installed as self-contained units located on the rooftops. These rooftop units are stored as multi-unit stacks and have to be transported to the commercial building for installation. The transportation is typically accomplished using a semi-trailer truck. To use the space on the semi-trailer truck efficiently, two rooftop HVAC units are often stacked on top of each other, placed a flatbed trailer, and strapped in place. The stacking may poses certain risks of damage to the rooftop units. To avoid damage, wood crates have at times been used.

SUMMARY

According to an illustrative embodiment of the disclosure, a system for securing at least two heating, ventilation, and air conditioning (HVAC) units stacked on each other for transportation includes a first HVAC unit having a bottom frame formed with base rails. The first HVAC unit having four bottom corners on a bottom portion and a top planar surface forming four top corners on a top portion. The system further includes a second HVAC unit having a bottom frame formed with base rails and having four bottom corners on a bottom portion and a top planar surface forming four top corners on a top portion. The system further includes a first corner bracket, a second corner bracket, a third corner bracket, and a fourth corner bracket applied to each of the four top corners of the first HVAC unit.

The system also has a first lateral banding member extending laterally across the first HVAC unit going from a first longitudinal side of the first HVAC unit to a second longitudinal side of the first HVAC unit. The first lateral banding member extending over and held in place by the first and second corner brackets. The system also has a second lateral banding member extending laterally across the first HVAC unit going from a first longitudinal side of the first HVAC unit to a second longitudinal side of the first HVAC unit. The second lateral banding member extending over and held in place by the third and fourth corner brackets.

The system further includes a first plank member extending between and secured to the first corner bracket and the fourth corner bracket and positioned proximate a first longitudinal edge of the first HVAC unit. The system also has a second plank member extending between and secured to the second corner bracket and the third corner bracket and positioned proximate a second longitudinal edge of the first HVAC unit. Each of the first, second, third, and fourth corner brackets each are formed from a bracket body having at least one lateral banding channel and having a plank-receiving channel.

According to another illustrative embodiment of the disclosure, a corner bracket for placing on four corners of a first HVAC unit to assist with stacking a second HVAC unit on the first HVAC unit includes a bracket body formed from a synthetic material and formed with a plank-receiving channel. The bracket body is formed from a synthetic material and has a top side, an outer lateral side, an inner lateral side, an outer longitudinal side, and an inner longitudinal side with reference to an installed position. The bracket also includes a first top protrusion formed on the top side of the bracket body and extending vertically away from other portions of the bracket body on the top side to define a first height and positioned proximate an interface of the inner lateral side and the top side. The first top protrusion is for positioning a portion of a base rail of a bottom frame of the second HVAC unit and includes a banding channel formed laterally across the top side of the bracket body for receiving one or more bands.

The corner bracket further includes a second top protrusion formed on the top side of the bracket body and extending vertically away from other portions of the bracket body on the top side to define a second height. The second top protrusion displaced longitudinally from the first top protrusion to form a lateral, top strapping channel between the first top protrusion and the second top protrusion. The corner bracket also having a first outer longitudinal protrusion and a second out longitudinal protrusion formed on the bracket body and displaced from one another to form a longitudinal strapping channel for receiving a strap. The plank-receiving channel is sized and configured to receive the plank member.

According to an illustrative embodiment of the disclosure, a corner bracket for use on the top corners of HVAC units when stacked for transportation includes a bracket body formed from a synthetic material and formed with a longitudinal plank-receiving channel for receiving a plank extending longitudinally between longitudinally opposed corner brackets when in a deployed position with a corner bracket on each corner of the HVAC unit. The corner bracket includes a plurality of protrusions formed on a top surface of the bracket body for defining a first strapping channel. The first strapping channel is sized configured to receive a first trailer strap. The first trailer strap is held in relative position when deployed by the first strapping channel. The corner bracket also includes a lateral banding channel formed on the top surface of the bracket body for receiving banding member to hold the corner bracket in position. The corner bracket also includes a plurality of side protrusions for forming at least a second strapping channel. The second strapping channel is sized and configured to receive a second trailer strap that is held in relative position by the plurality of side protrusions that form the second strapping channel. Other embodiments are disclosed herein.

BRIEF DESCRIPTION

Reference is now made to the following descriptions taken in conjunction with the accompanying drawings, in which.

DETAILED DESCRIPTION

Figure 1:
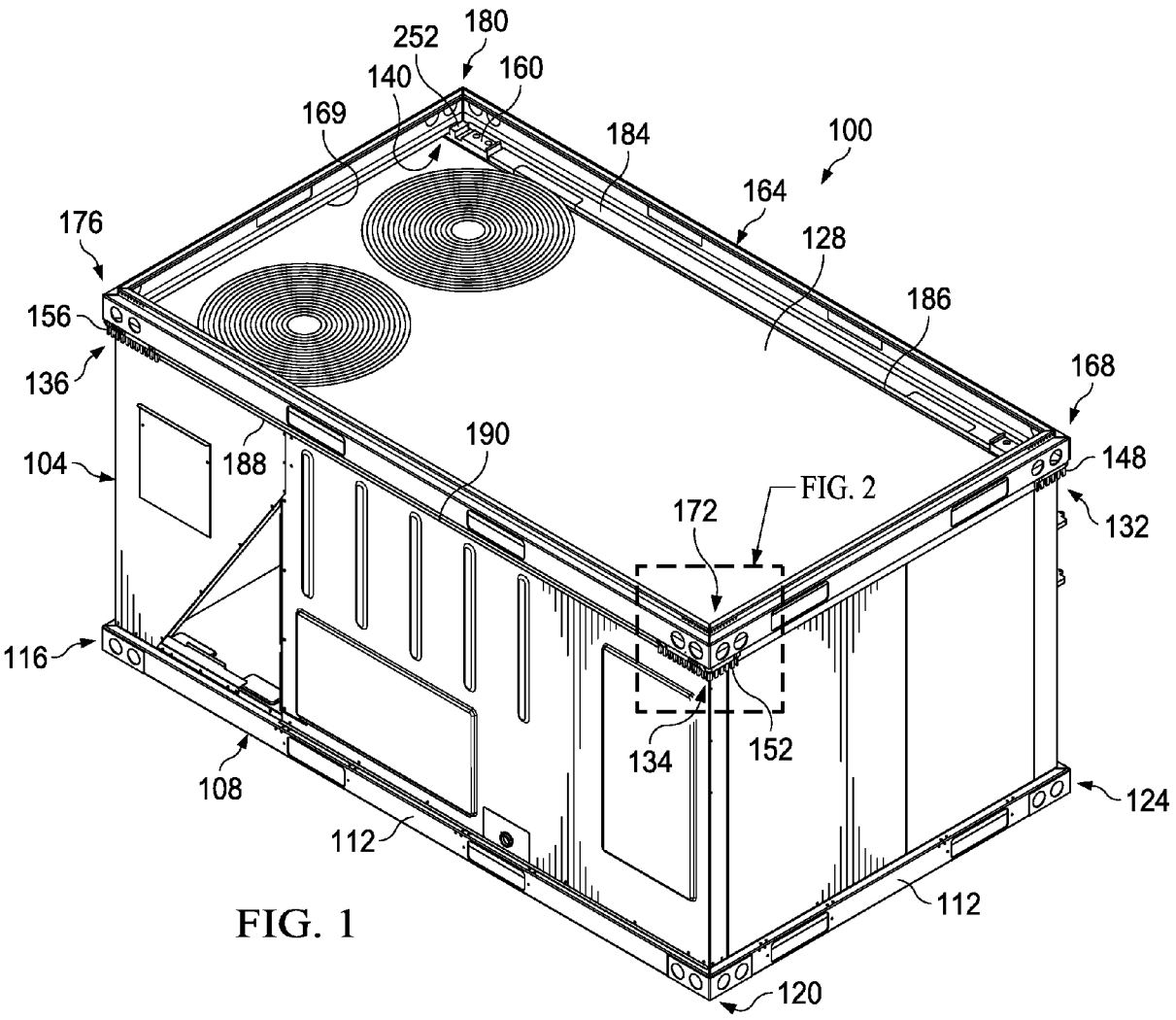
FIG. 1 is a schematic perspective view of part of an illustrative embodiment of a system for securing at least two heating, ventilation, and air-conditioning (HVAC) units.

Referring now to the figures, and initially and primarily to FIG. 1, a portion of a system 100 for securing at least two heating, ventilation, and air-conditioning (HVAC) units stacked on each other for transportation is presented. A first HVAC unit 104 is shown, which is a roof-top HVAC unit having a bottom frame 108 formed with base rails 112 and having four bottom corners of which three 116, 120, and 124 are visible. The first HVAC unit 104 includes a top planar surface 128 having top four corners 132, 134, 146, 140. A first corner bracket 148 is shown positioned on top corner 132. A second corner bracket 152 is shown positioned on the top corner 134. A third corner bracket 156 is shown positioned on top corner 136. Finally, a fourth corner bracket 160 is shown positioned on top corner 140.

A second HVAC unit would be stacked on top of the first HVAC unit 104. The second HVAC unit is analogous to the first HVAC unit 104. For illustration purposes, only a bottom frame 164 of the second HVAC unit is shown on top of the first HVAC unit 104. The bottom frame 164 of the second HVAC unit has four corners 168, 172, 176, and 180 that are shown resting on the four corner brackets 148, 152, 156, and 160. In this view, the fourth corner 180 can be seen to the outboard of much of the fourth corner bracket 160.

Figure 2:
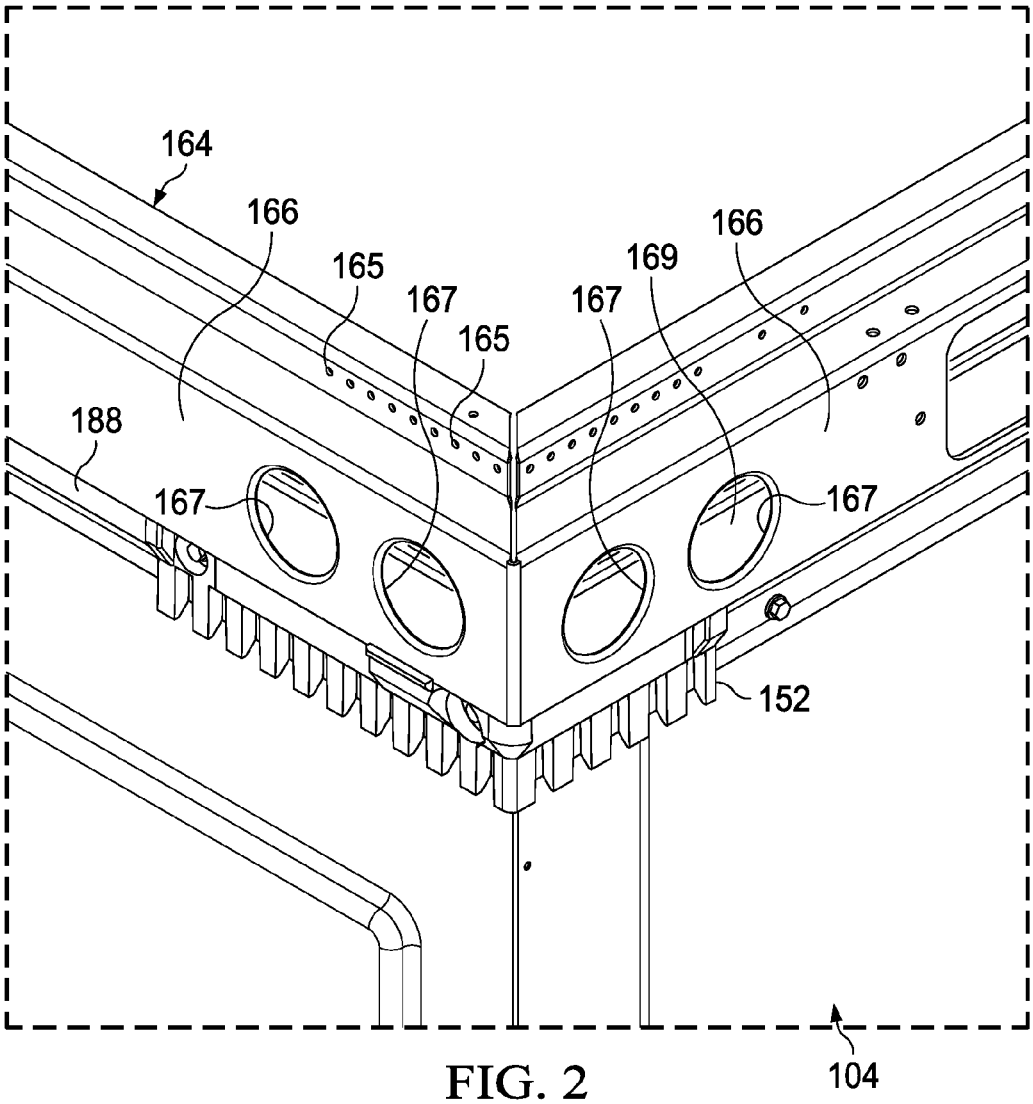
FIG. 2 is a detail of a portion of the system of FIG. 1.

Referring now primarily to FIG. 2, the bottom frame 164 of a second HVAC unit is shown in more detail resting on the second corner bracket 152. The bottom frame 164 includes bottom rails 166 that may be formed with a plurality of access openings 167 to accommodate banding and to provide visibility and other access. The bottom frame 164 may be coupled to sheet metal or other aspects of the second HVAC unit using fasteners going through a plurality of fastener holes 165. Each bottom rail 166 has a bottom member 169 that forms a surface that rests upon the corner brackets, e.g., second corner bracket 152.

Referring to FIGS. 1 and 2, a first plank member 184 is shown extending longitudinally between the first corner bracket 148 and the fourth corner bracket 160. The first plank member 184 is positioned proximate a first longitudinal edge 186 of the first HVAC unit 104. The second plank member 188 is shown extending longitudinally between the second corner bracket 152 and the third corner bracket 156. The second plank member 188 is positioned proximate a second longitudinal edge 190 of the first HVAC unit 104. As will be described further below, the plank members 184 and 188 extend within plank-receiving channels in their respective corner brackets. The plank members 184 and 188 may be made from wood, composite wood, high-density polyethylene, or other materials that are strong enough to distribute forces. In one illustrative embodiment, the planks 184, 188 were formed from 1"×4" wood members, but 2×4" or other dimensions and materials may readily be used. The planks 184, 188 may help keep the corner brackets from flexing inward and help to distribute loads outward to where there is more strength in the HVAC units. The planks may also tie the corner brackets together in the longitudinal direction. Screws are currently used as fasteners but a peg or other locking means could be used to tie together the planks and the brackets.

Figure 3:
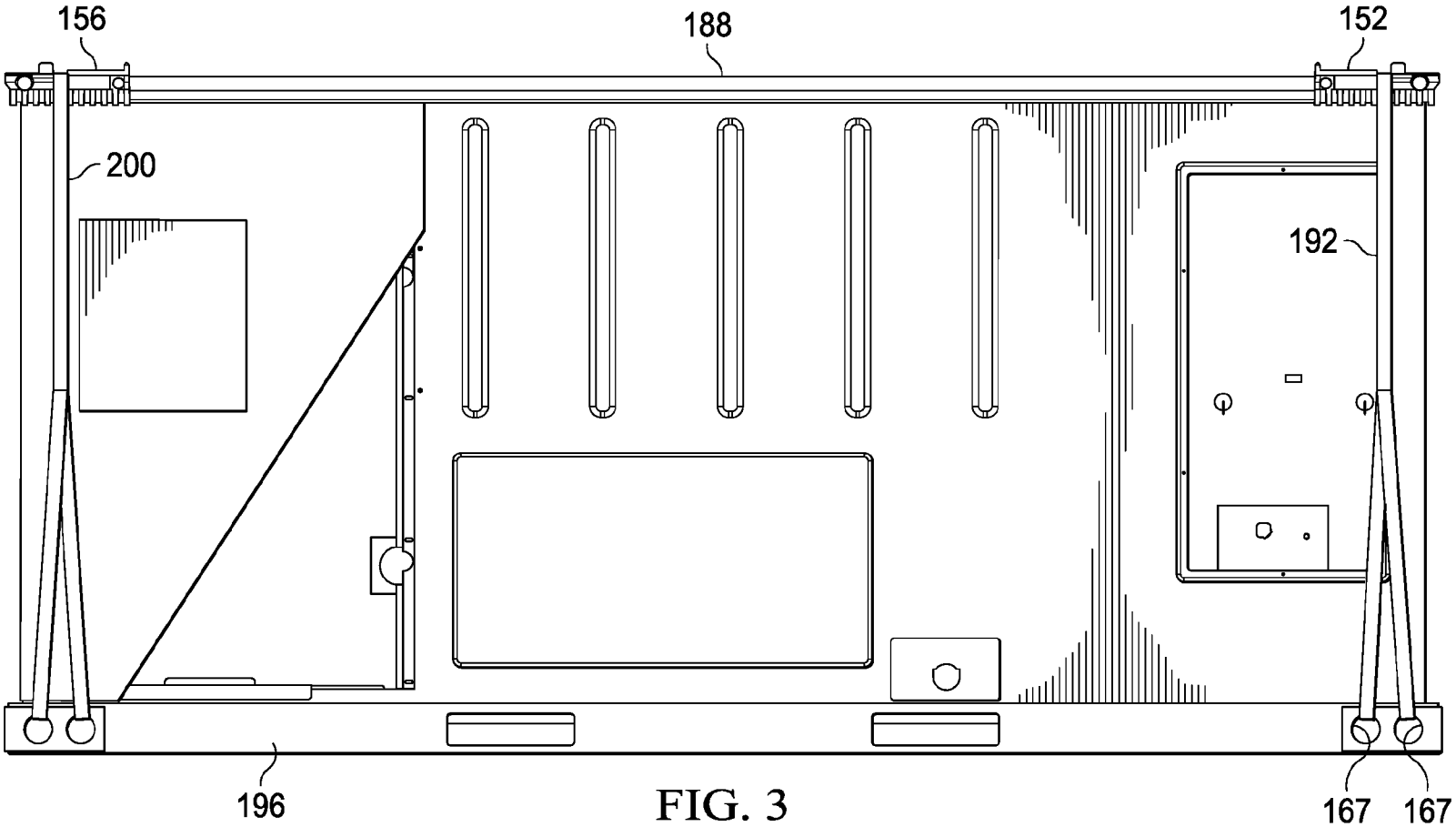
FIG. 3 is a schematic, side elevational view of an HVAC unit showing banding deployed and in place for holding two corner brackets in place.

Referring primarily now primarily to FIG. 3, in this front elevation view, the second corner bracket 152 and third corner bracket 156 are shown in position on the top corners 172 and 176 respectively. In this view, a first lateral banding member 192 is shown going across a top portion of the second corner bracket 152 and looping through two of the access openings 167. The first lateral banding member 192 thus extends laterally across the top of the first HVAC unit 104 going from a first longitudinal side (not shown in FIG. 3) across the first corner bracket 148 (not shown in FIG. 3) and the second corner bracket 152 down to a second longitudinal side 196 of the first HVAC unit 104. As will be explained further below, a first lateral banding member 192 is held in place by banding channels. A second lateral banding member 200 extends laterally across the first HVAC unit 104 going from a first longitudinal side, across the top, to a second longitudinal side 196. Again, as will be explained, lateral banding channels on the third corner bracket 156 and the fourth corner bracket 160 hold the banding member in place.

While not explicitly shown, the second HVAC unit is analogous to the first HVAC unit 104 and for a number of reasons may also have four corner brackets applied to its four top corners. These additional brackets—fifth, sixth, seventh, and eighth stacking brackets—are analogous to the other corner brackets and are positioned on the four top corners to accommodate banding of the two HVAC units together for stability and protection. Moreover, in some situations, three HVAC units may be stacked or other items placed on top.

Figure 4:
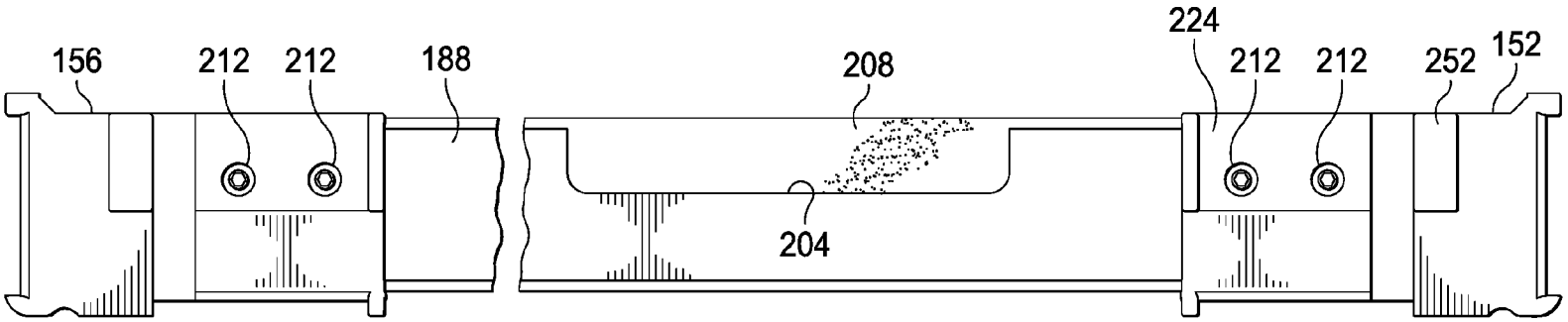
FIG. 4 is a schematic plan view of a portion of the system of FIG. 1 showing two corner brackets and a plank.

Referring now to primarily FIGS. 4-10, an illustrative non-limiting embodiment of the stacking brackets will be presented. Referring initially to FIG. 4, a top schematic plan view of the second corner bracket 152 and third corner bracket 156 are shown with second plank member 188 between the corner brackets 152, 156. In this embodiment, the second plank member 188 is shown with a notch 204 cut out of an inner longitudinal edge in order to accommodate a particular HVAC unit. In addition, an optional foam member 208 is shown extending beyond a periphery of the second plank member 188.

Figure 5:
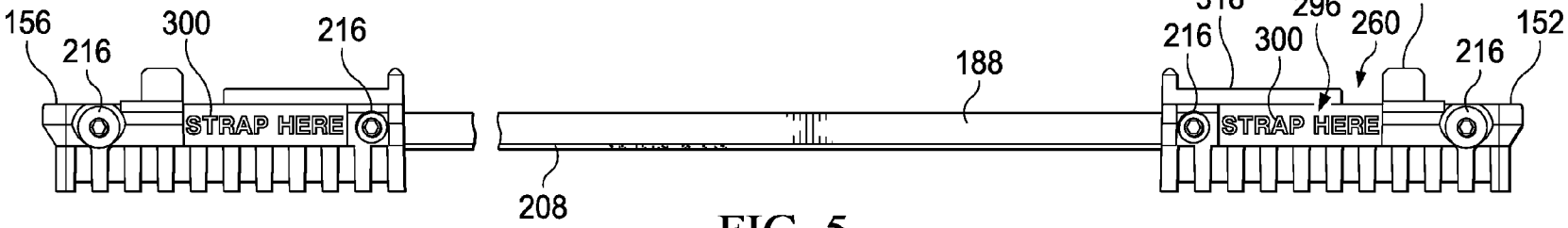
FIG. 5 is a schematic elevation view of the two corner brackets and plank of FIG. 3.

FIG. 5 is a side elevation view of FIG. 4. For this illustrative embodiment, it will be appreciated that there are two fastener recesses 212 formed on a top portion of each bracket and two fastener recesses 216 formed on a side portion. The other side of the brackets may also have fastener recesses. Each of the fastener recesses 212, 216 allow for fasteners to extend through the corner bracket and into the plank member to help secure the plank member within a plank-receiving channel (see 228 in FIGS. 7 and 9). This wall may also be used to pre-locate the assembled bracket and plank against the unit along its length so that the top locating features 252 are not considerably misaligned.

Continuing to refer to FIGS. 4-10, the second corner bracket 152 will be described in more detail. Those skilled in the art will appreciate that all of the brackets herein are analogous although some are mirror images of the others. The second corner bracket 152 is formed as a bracket body 224 from a synthetic material, such as polypropylene or recycled polypropylene. The bracket body 224 may take a number of shapes; for example, in one illustrative, non-limiting embodiment, the bracket body 224 is in the form of a cuboid shaped member with a plank-receiving channel 228. The bracket body 224 is formed with the plank-receiving channel 228 as shown best in FIG. 9.

The plank-receiving channel 228 is sized and configured to receive the corresponding plank member. The plank-receiving channel 228 may take numerous shapes and in one embodiment may be a channel having an open side and in another embodiment may form a plank-receiving socket having a top wall, bottom wall, first side wall, second side wall, and an end wall. The bracket body 224 has a top side 232, an outer lateral side 236, an inner lateral side 240, an outer longitudinal side 244, and an inner longitudinal side 248. It will be appreciated that the top side 232 has various features with different heights that may be referenced by an average height for all the surfaces from a datum.

Figure 8:
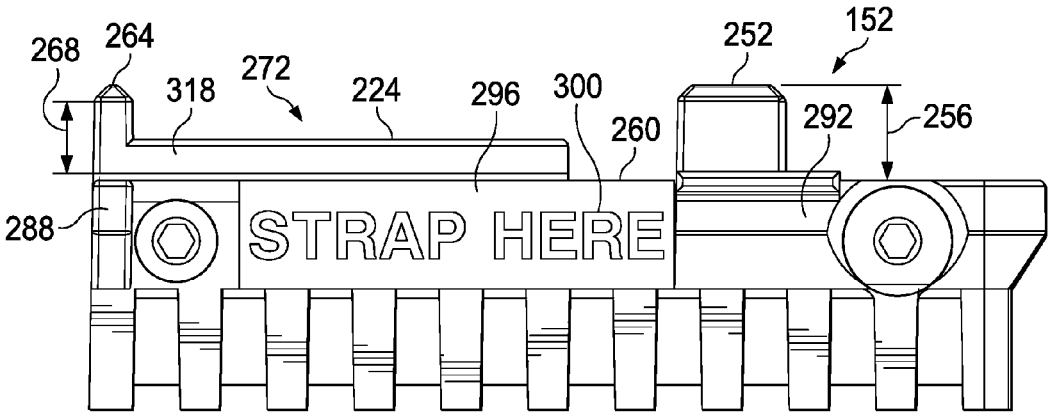
FIG. 8 is a schematic elevation view of the corner bracket of FIG. 6.

In this regard, a first protrusion 252 is formed on the top side 232 of the bracket body 224 and extends vertically away from other portions of the bracket body 224 (e.g., from the average height for all the surfaces from a datum) to define a first height 256 (FIG. 8). The first protrusion 252 is positioned proximate an interface, or edge, of the inner lateral side 240 and the top side 232. The first protrusion 252 helps to position and maintain a portion of the base rail or the corner of the bottom frame 164 of the second HVAC unit as is shown on the fourth corner bracket 160 in FIG. 1. A lateral banding channel 260 is formed in the bracket body 224 by forming the channel 260 beneath other portions of the top surface or side 232 or by using one or more protrusions on each side, such as the first protrusion 252. The banding channel 260 on each corner bracket provides a place to securely hold the banding member, e.g. banding members 192, 200, and may recess the banding member to avoid abrasion. The banding channel 260 may be formed adjacent to the first protrusion 252 or to the other location on the top side 232.

A second top protrusion 264 is formed on the bracket body 224 on the top side 232 and extends vertically away from other portions of the bracket body 224 on the top side 232 to define a second height 268 (FIG. 8). The first height 256 and the second height 268 may be at least ¼ of an inch. The second top protrusion 264 is displaced longitudinally from the first top protrusion 252 to form a lateral, top strapping channel 272 between the first top protrusion 252 and the second top protrusion 264. The second top protrusion 264 may act to give some redundancy for containing any units stacked on top if the primary larger protrusion 252 is damaged.

Figure 7:
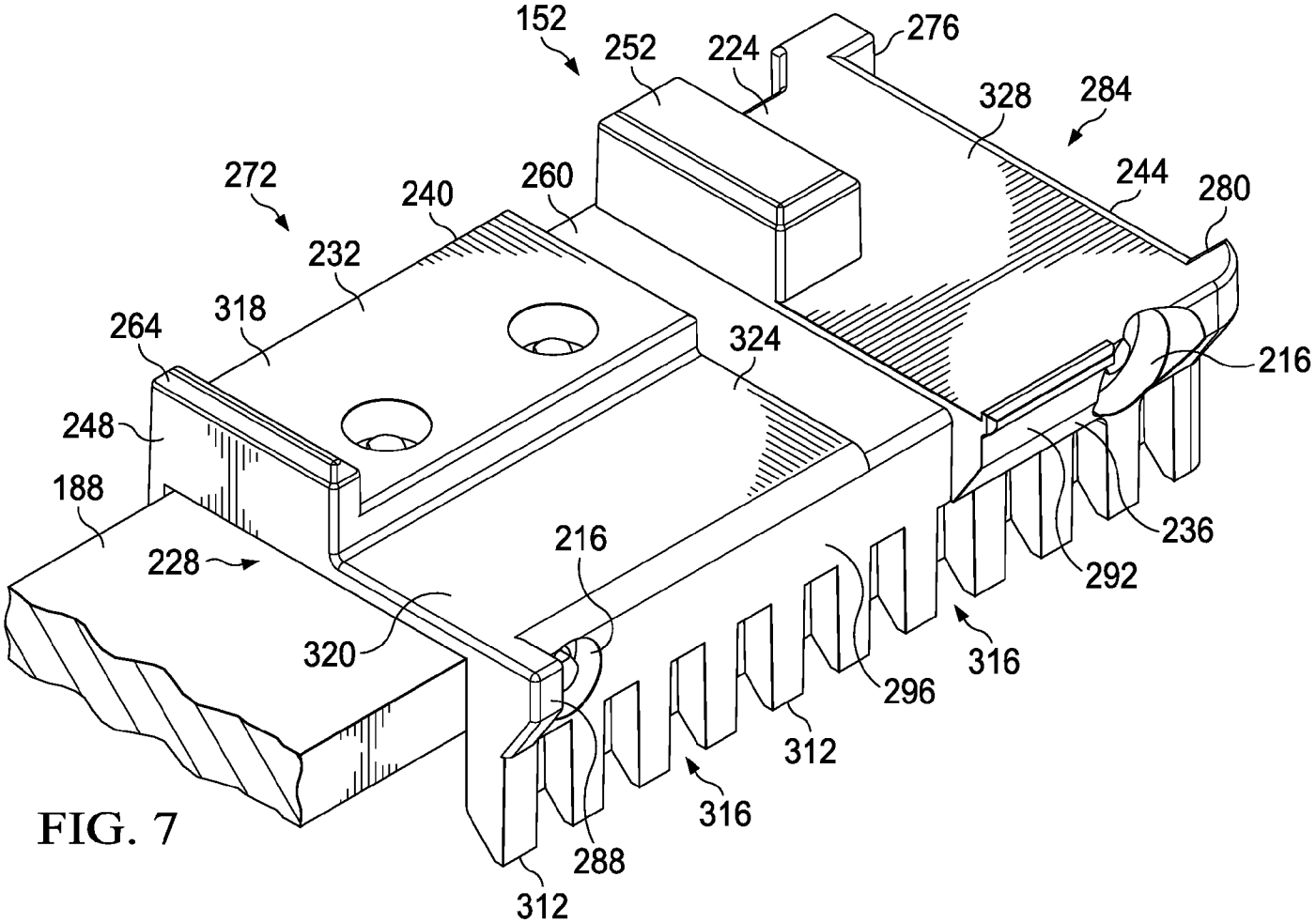
FIG. 7 is a schematic, perspective view of an illustrative embodiment of a corner bracket according to one illustrative embodiment.

The bracket body 224 may also have a third top protrusion portion 318 shown best in FIGS. 5 and 7 with a height less than the first height 256 and second height 268. This third protrusion may assist with sufficient thickness for fasteners or may provide additional support area.

The bracket body 224 is also formed with a first outer longitudinal protrusion 276 and a second outer longitudinal protrusion 280. The first outer longitudinal protrusion 276 and the second outer longitudinal protrusion 280 are displaced from one another to form a longitudinal strapping channel 284 for receiving a strap on a semi-trailer.

As shown best in FIG. 7, the bracket body 224 may also include a first outer lateral protrusion 288 and a second outer lateral protrusion 292 that are displaced from one another to form a lateral strapping channel 296. As shown best in FIGS. 5 and 6, the strapping channels (longitudinal strapping channel 284 and lateral strapping channel 296) may have visual indicia 300 applied to provide instructions. In the example shown, the visual indicia 300 says "strap here," but any helpful information may be added. In some embodiments, the visual indicia 300 may be made from a reflective material to assist forklift drivers in seeing it in warehouses and places where lighting is minimal.

As shown best in FIG. 7, an L-shaped rail-receiving area 320 may be formed as an aspect of the top side 232. The L-shaped rail-receiving area 320 has a longitudinal portion 324 extending longitudinally and near the outer lateral side and has a lateral portion 328 extending laterally across the bracket on an outer longitudinal edge. The L-shaped rail-receiving area 320 is for receiving a corner of the bottom frame of an HVAC unit. In this embodiment, the bottom frame of the HVAC unit is received in the L-shaped rail-receiving area 320 outboard of the protrusions 252, 264, 318. This can be seen, again, on the fourth corner bracket 160 in FIG. 1. In an alternative embodiment, the protrusions could be outboard of the area for receiving the bottom frame.

Figure 9:
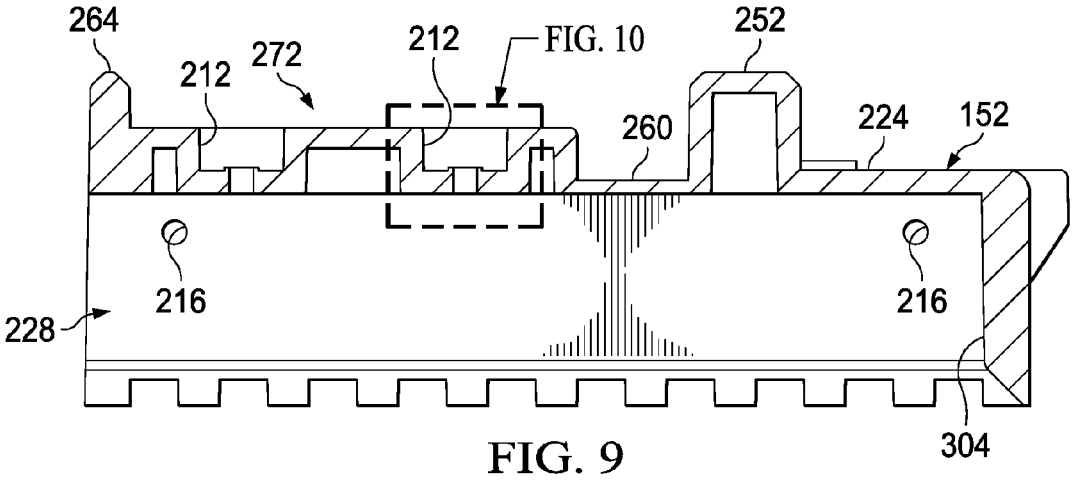
FIG. 9 is a schematic, cross-sectional view of the corner bracket of FIG. 6 taken along a line running through the two fastener recesses on the top surface.
Figure 10:
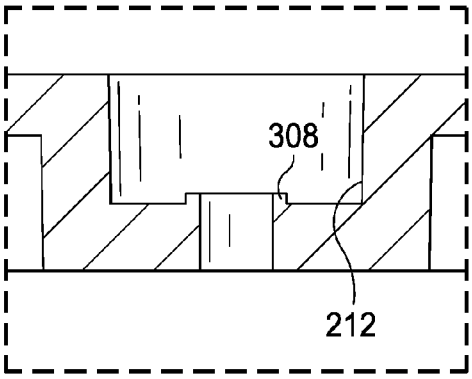
FIG. 10 is a detail from FIG. 8.

As shown best in FIGS. 9 and 10, in one illustrative, non-limiting embodiment, the plank member, e.g., second plank member 188, is inserted into the corresponding plank-receiving channel, e.g., plank receiving channel 228, until a longitudinal end of the plank member is against an internal wall 304 and then fasteners may be applied through the plurality of fastener recesses 212, 216. As shown in FIG. 10, each of the fastener recesses 212 (or 216) may be formed with a protruding lip member 308 to counter wear or other issues from the fastener—particularly if sheet metal screws are used for the fastener. In other embodiments, the plank member may be held in place by an interference fit (snap-together design), glue, screws, or other fastening technique.

Figure 6:
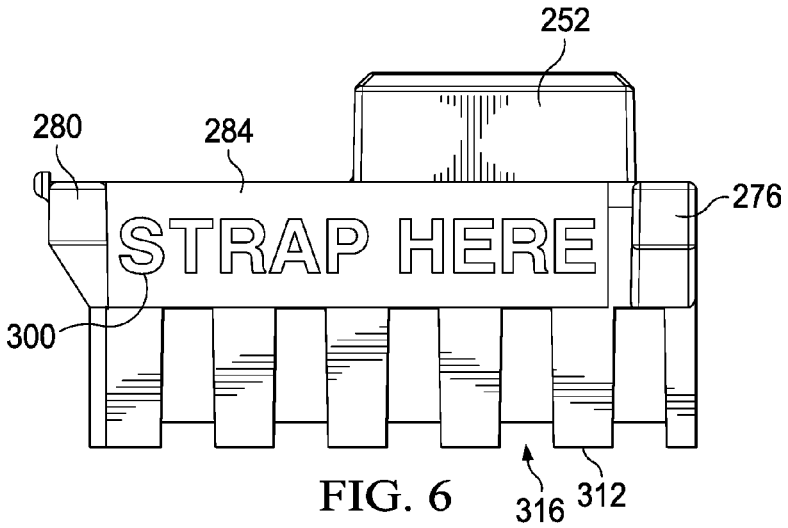
FIG. 6 is an end view of one of the corner brackets from FIG. 4.

The corner bracket 152 may include a plurality of ridges 312 with a corresponding plurality of void spaces 316. The plurality of void spaces 316 allow for less material to be used and makes the part more lightweight. The plurality of ridges 312 and void spaces 316 may be formed on both of the lateral sides or just one of the lateral sides. The ridges 312 and void spaces 316 may also be formed on the longitudinal side as shown in FIG. 6.

In use, first HVAC unit 104 may have four corner brackets 148, 152, 156, and 160 applied to the top corners. Banding is then run laterally across the unit through the banding channels 260 and through one or more of the access openings 167 on each side of the lower frame member of the first HVAC unit. In this way, the corner brackets are securely attached to the first HVAC unit. Then, the second HVAC unit may be placed on top of the first HVAC unit 104 with the second bottom frame 164 resting on each of the corner brackets. Four more corner brackets, i.e., fifth, sixth, seventh, and eighth corner brackets, may be applied to the top corners of the second HVAC unit. A second banding member may be applied across the second HVAC unit. The banding member may run from either the access openings 167 on the bottom frame of the first HVAC member or some embodiments could be from the second bottom frame 164. More typically, the banding would be from the bottom frame 108 of the first HVAC unit across the corner brackets on the second HVAC units at the top and then back down to the bottom frame 108 of the first HVAC unit and tightened to hold the whole unit securely in place. The banding need not go through the access openings or eyelets, but could go underneath the unit.

The unit may then be placed on a flat bed of a semi-trailer truck. Strapping members may then be run in two directions laterally and longitudinally. The lateral strapping may be held in place by the lateral strapping channel 296 and the longitudinal strapping may be held in place by the longitudinal strapping channel 284. The process is reversed upon arrival at the commercial building and the corner brackets may be easily removed, and one may readily dispose of them.

The brackets and planks herein may perform multiple functions: protect the product from damage during stacking and unstacking, secure the product when multiple units are transported; protect the unit during shipment even when only one unit is being transported, or provide a location for strapping on flatbed trailers.

As used herein, the term "coupled" includes coupling via a separate object and includes direct coupling. The term "coupled" also encompasses two or more components that are continuous with one another by virtue of each of the components being formed from the same piece of material or associated one to another by a magnetic field.

The present invention and its advantages have been disclosed in the context of certain illustrative, non-limiting embodiments. The illustrative descriptions above are not intended to be exhaustive or to limit the invention to the precise forms disclosed. Moreover, it should be understood that various changes, substitutions, permutations, and alterations can be made without departing from the scope of the invention as defined by the appended claims. It will be appreciated that any feature that is described in connection to any one embodiment may also be applicable to any other embodiment.

What is claimed is:

1. A system for securing at least two heating, ventilation, and air conditioning units stacked on each other for transportation, the system comprising:

a first heating, ventilation, and air conditioning unit having a bottom frame formed with base rails and having four bottom corners on a bottom portion and a top planar surface forming four top corners on a top portion;

a second heating, ventilation, and air conditioning unit having a bottom frame formed with base rails and having four bottom corners on a bottom portion and a top planar surface forming four top corners on a top portion;

a first corner bracket, a second corner bracket, a third corner bracket, and a fourth corner bracket applied to each of the four top corners of the first heating, ventilation, and air conditioning unit;

a first lateral banding member extending laterally across the first heating, ventilation, and air conditioning unit going from a first longitudinal side of the first heating, ventilation, and air conditioning unit to a second longitudinal side of the first heating, ventilation, and air conditioning unit, the first lateral banding member extending over and held in place by the first and second corner brackets;

a second lateral banding member extending laterally across the first heating, ventilation, and air conditioning unit going from a first longitudinal side of the first heating, ventilation, and air conditioning unit to a second longitudinal side of the first heating, ventilation, and air conditioning unit, the second lateral banding member extending over and held in place by the third and fourth corner brackets;

a first plank member extending between and secured to the first corner bracket and the fourth corner bracket and positioned proximate a first longitudinal edge of the first heating, ventilation, and air conditioning unit;

a second plank member extending between and secured to the second corner bracket and the third corner bracket and positioned proximate a second longitudinal edge of the first heating, ventilation, and air conditioning unit; and wherein the first, second, third, and fourth corner brackets are each formed from a bracket body having at least one lateral banding channel and having a plank-receiving channel.

2. The system of claim 1, wherein the first plank member and second plank member are formed from wood and each of the first, second, third, and fourth corner brackets are formed from a synthetic material.

3. The system of claim 2, wherein the synthetic material is polypropylene.

4. The system of claim 1, further comprising a plurality of fasteners extending through the first, second, third, and fourth bracket members and into the first plank member or second plank member.

5. The system of claim 1, wherein in each of the first, second, third, and fourth corner brackets has a plurality of ridges that form a plurality of void spaces.

6. The system of claim 1, further comprising fifth, sixth, seventh, and eighth stacking brackets, wherein one of the fifth, sixth, seventh, and eighth stacking brackets are positioned at each of the four top corners of the second heating, ventilation, and air conditioning unit.

7. The system of claim 1, wherein each of the first, second, third, and fourth corner brackets are formed with a L-shaped rail-receiving area for receiving a bottom corner of the bottom frame of the second heating, ventilation, and air conditioning unit.

8. The system of claim 7, further comprising:

a third lateral banding member extending laterally across the second heating, ventilation, and air conditioning unit going from a first longitudinal side of the second heating, ventilation, and air conditioning unit to a second longitudinal side of the second heating, ventilation, and air conditioning unit and the third lateral banding member extending over and held in place by the fifth and sixth corner brackets;

a fourth lateral banding member extending laterally across the second heating, ventilation, and air conditioning unit going from a first longitudinal side of the second heating, ventilation, and air conditioning unit to a second longitudinal side of the second heating, ventilation, and air conditioning unit and the fourth lateral banding member extending over and held in place by the seventh and eighth corner brackets;

a third plank member extending between and secured to the fifth corner bracket and the eighth corner bracket and positioned proximate a first longitudinal edge of the second heating, ventilation, and air conditioning unit;

a fourth plank member extending between and secured to the sixth corner bracket and the seventh corner bracket and positioned proximate a second longitudinal edge of the second heating, ventilation, and air conditioning unit; and wherein the fifth, sixth, seventh, and eighth corner brackets are each formed from a bracket body having at least one lateral banding channel and having a longitudinal plank-receiving channel.

9. A corner bracket for placing on four corners of a heating, ventilation, and air conditioning unit, the corner bracket comprising:

a bracket body formed from a synthetic material and formed with a plank-receiving channel;

the bracket body formed from a synthetic material and having a top side, an outer lateral side, an inner lateral side, an outer longitudinal side, and an inner longitudinal side with reference to an installed position;

a first top protrusion formed on the top side of the bracket body and extending vertically away from other portions of the bracket body on the top side to define a first height and positioned proximate an interface of the inner lateral side and the top side;

a banding channel formed laterally across the top side of the bracket body for receiving one or more bands;

a second top protrusion formed on the top side of the bracket body and extending vertically away from other portions of the bracket body on the top side to define a second height and the second top protrusion displaced longitudinally from the first top protrusion to form a lateral, top strapping channel between the first top protrusion and the second top protrusion; and a first outer longitudinal protrusion and a second outer longitudinal protrusion formed on the bracket body and displaced from one another to form a longitudinal strapping channel for receiving a strap; and wherein the plank-receiving channel is sized and configured to receive the plank member.

10. The corner bracket of claim 9, further comprising a first outer lateral protrusion and a second outer lateral protrusion formed on the bracket body and displaced from one another to form a lateral strapping channel for receiving a strap.

11. The corner bracket of claim 9, wherein visual indicia is applied to the longitudinal strapping channel.

12. The corner bracket of claim 11, wherein the visual indicia is formed from a reflective material.

13. The corner bracket of claim 9, wherein the bracket body is formed from polypropylene.

14. The corner bracket of claim 9, wherein the plank-receiving channel comprises a plank-receiving socket having a top wall, bottom wall, first side wall, second side wall, and an end wall.

15. The corner bracket of claim 9, wherein the bracket body is formed with a plurality of fastener recesses each for receiving a fastener to secure a plank member in the plank-receiving channel, and wherein each of the fastener recesses includes a protruding lip member.

16. The corner bracket of claim 9, wherein the bracket body is formed as a cuboid shaped member with the plank-receiving channel.

17. The corner bracket of claim 9, wherein the banding channel is formed adjacent to the first protrusion.

18. The corner bracket of claim 9, wherein the first height of the first protrusion and the second height of the second protrusion are each at least ¼ of inch.

19. The corner bracket of claim 9, further comprising a plurality of ridges formed on the first longitudinal side and the second longitudinal side to form a plurality of void spaces.

20. A corner bracket for use on the top corners of heating, ventilation, and air conditioning units when stacked for transportation, the corner bracket comprising:

a bracket body form from a synthetic material and formed with a longitudinal plank-receiving channel for receiving a plank extending longitudinally between longitudinally opposed corner brackets when in a deployed position with a corner bracket on each corner of the heating, ventilation, and air conditioning unit;

a plurality of protrusions formed on a top surface of the bracket body for defining a first strapping channel, wherein a the first strapping channel is sized configured to receive a first trailer strap that is held in relative position by the first strapping channel;

a lateral banding channel formed on the top surface of the bracket body for receiving banding member to hold the corner bracket in position; and a plurality of side protrusions for forming at least a second strapping channel, wherein the second strapping channel is sized and configured to receive a second trailer strap that is held in relative position by the plurality of side protrusions that form the second strapping channel.

* * * * *